United States Patent [19]

Buckley

[11] Patent Number: 4,564,968

[45] Date of Patent: Jan. 21, 1986

[54] HAND-CLEANING DEVICE

[76] Inventor: Elizabeth Buckley, 401 Morrissey Blvd., Dorchester, Mass. 02125

[21] Appl. No.: 682,550

[22] Filed: Dec. 17, 1984

[51] Int. Cl.[4] ..... A47K 7/04

[52] U.S. Cl. ..... 15/21 R; 15/97 R

[58] Field of Search ..... 15/21 R, 21 C, 21 D, 15/21 E, 97 R, 3.1, 3.12, 104.92, 70

[56] References Cited

U.S. PATENT DOCUMENTS 2,952,859 9/1960 Alcamo ..... 15/21 D 2,961,672 11/1960 Alcamo ..... 15/21 R 3,918,117 11/1975 Plante ..... 15/21 D 4,130,908 12/1978 Alcamo ..... 15/21 R

*Primary Examiner*—Edward L. Roberts

*Attorney, Agent, or Firm*—William Nitkin

[57] ABSTRACT

A device to clean the hands, fingers and forearms having an outer drum, a perforated stationary drum contained concentrically within the outer drum, and a perforated movable drum having brush members arrayed around its inside rotatably mounted within the perforated stationary drum adapted to receive water containing a cleansing agent and to clean and rinse a hand inserted into the rotating perforated drum with the hand scrubbed by the brush members rotating around the hand.

3 Claims, 4 Drawing Figures

HAND-CLEANING DEVICE

BACKGROUND OF THE INVENTION

1. Field of the Invention

The device of this invention resides in the field of hand cleaners and more particularly relates to a device for the scrubbing of hands, forearms and fingers especially useful in the medical field for an individual to clean his hands quickly, thoroughly and efficiently before touching patients.

2. History of the Prior Art

Devices for the washing of arms, hands and fingers presently exist such as disclosed in U.S. Pat. No. 4,020,856 to Masterson in which the user inserts his hand and jet sprays of water emanating from nozzles surrounding the hand, spray the hand thereby cleaning it. Another device that requires user movement within it is described in Multidigital Surgical Scrub Brush, U.S. Pat. No. 3,966,335 to Abramson which device consists of a brush system having a plurality of apertures therein for the user to insert his fingers and maneuver them back and forth thereby cleaning all sides of the fingers at one time. This device was created to speed up the cleaning of a surgeon's hands especially in a medical emergency situation. Other types of scrubbing devices not necessarily for use of the human body have been created over the years and patents disclosing such devices are listed below:

| | |
|---|---|
| 1,302,498 | Barron |
| 1,559,441 | Kundel |
| 2,629,124 | Merritt |
| 2,713,693 | Johnson |
| 4,069,536 | Hartz et al |
| 4,120,068 | Kaczmarek |
| 4,301,567 | Tucker |
| 4,380,839 | Caradonna |

SUMMARY OF THE INVENTION

It is an object of this invention to provide an improved surgical hand cleaner which is extremely efficient in its operation and which can save precious time in a medical emergency situation. The device can also be utilized not only in the medical field but in other fields where manual cleanliness is important. Such other fields would include restaurants, cafeterias and other sites involving food preparation and food service. The device of this invention can be positioned, for example, in a restaurant's kitchen area and/or restrooms and can be quickly utilized during the day by employees and waiters/waitresses engaged in food preparation and food service. The device of this invention can be further utilized in the home and any other area where efficient and thorough cleaning of the hands is desired. Further, the efficient usage of water by this device may result in a savings in overall water consumption for hand-cleaning. One could use two of these units at one time to clean both hands at the same time by placing a hand in each unit.

The device is comprised of a first outer drum closed at one end which forms an outer casing and a second concentric inner drum closed at one end which drum has a plurality of apertures defined in the sides thereof. Water is introduced by a pipe through the first outer drum between the first outer drum and the second inner perforated drum. Water passes through the perforations in the second inner drum to the interior of the second inner drum. Within the second inner drum is a rotatably-mounted and typically motor-driven third concentric drum closed at one end also having a plurality of apertures in the sides thereof for the passage of water therethrough. The third drum also contains a plurality of brush members attached to its inside surface extending radially inward. The brushes can have bristles of the type used for hand-washing. Water enters between the first outer drum and second inner drum, rises around the second inner drum, passes inside through all the perforations in the second inner drum, through aperture in the rotating third drum and around the brush members therein. The brush members extend inwardly toward the center of the third drum such that the tips of the brush members form an opening smaller than the circumference of a hand. However when one inserts his hand into the rotating third drum, the brush members yield and rub against the hand. The opening formed by the brush member can, in some embodiments, be larger in circumference than the hand. The water, which can be heated, passes around the hand and the brushes scrub any dirt or bacteria from the hand. The water accumulating at the bottom of the drums then passes out an aperture acting as a drain member in the base of the unit. The rotatable third drum can be driven by an electric motor attached to a shaft affixed at the rear of the drum or by equivalent means.

The device can be set to have three operating cycles: a wash cycle, a rinse cycle, and a sterilization cycle. Soap can be entered into the water during the wash cycle followed by clear rinse water to rinse soap off the user's hand. After the user has removed his hand from the interior of the device, extremely hot water with cleansing chemicals to sterilize the brush members and interior of the unit can enter the device. The water temperature can be controlled during the wash and rinse cycles by a thermostat or equivalent means well known in the art so as not to burn the user's hand. However during the sterilization cycle, water of very high temperature can be utilized.

A switch can be provided in front of the device to turn it on or off, or the device could be turned on or off by sensing devices well known in the art such as electric eyes or capacitance devices which would sense the presence of a hand within the device. A front cover for the unit should include at least a rim around the front to prevent water from spilling out of the area between the first and second concentric drums. Closure flaps can be provided to prevent water from splashing out the front of the device in front of the opening in the third drum. The drain of the unit should remove water at a rate related to the rate of water flow into the device so that water does not build up in the third drum and pour out the front of the device when in use.

DESCRIPTION OF THE PREFERRED EMBODIMENT(S)

Figure 1:
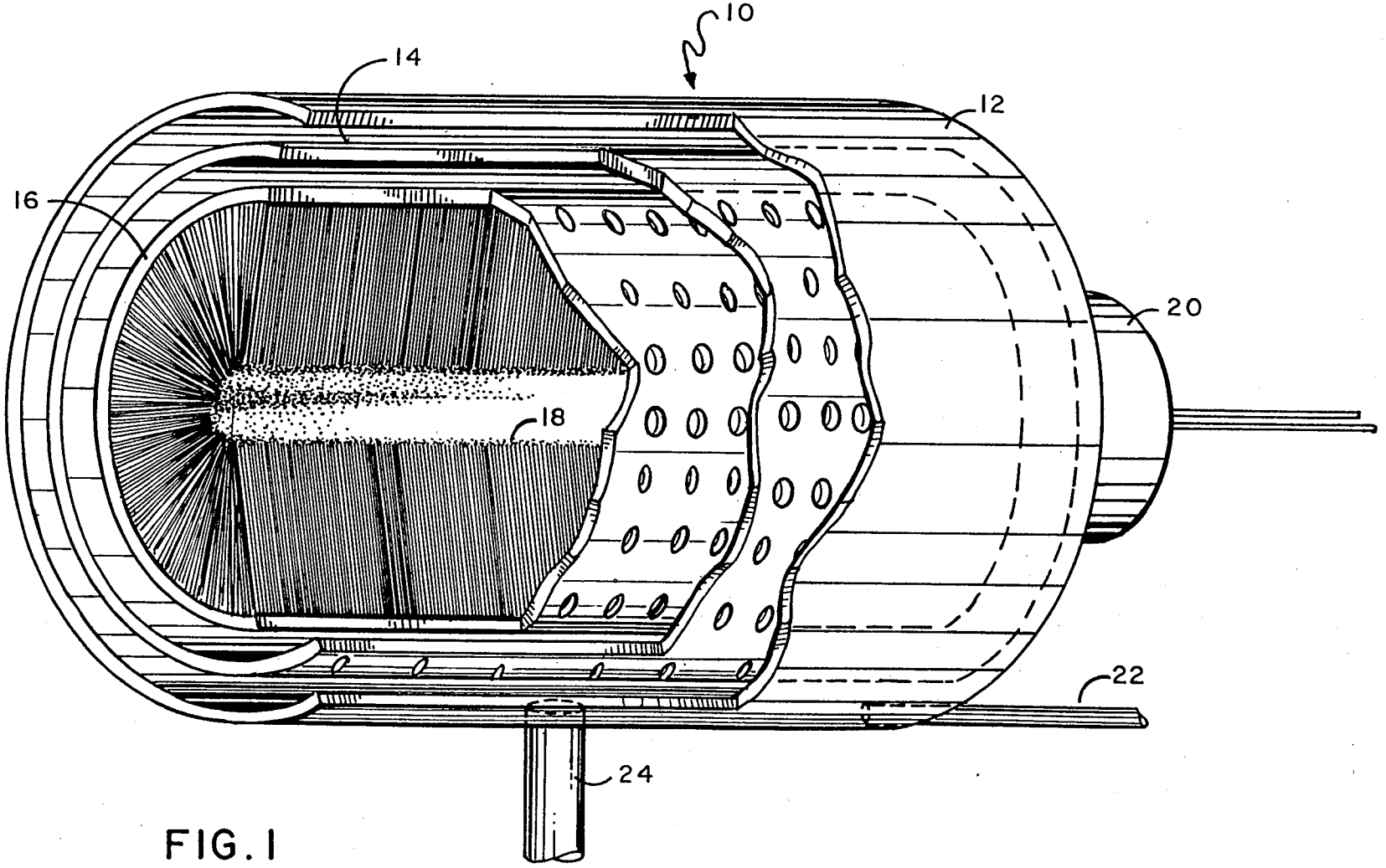
FIG. 1 illustrates a perspective cutaway view of the first, second and third concentric drums of this invention.
Figure 4:
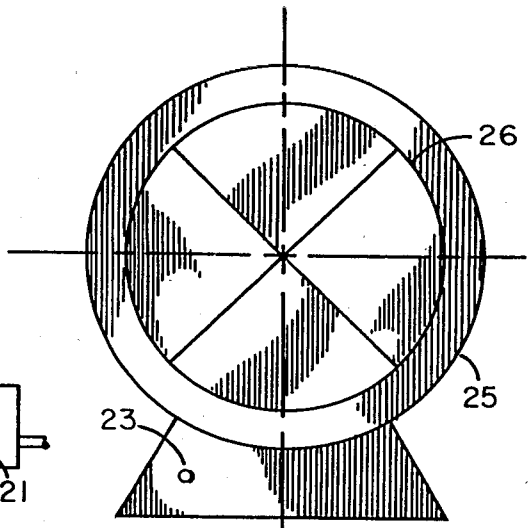
FIG. 4 illustrates a front view showing closure flaps.
Figure 2:
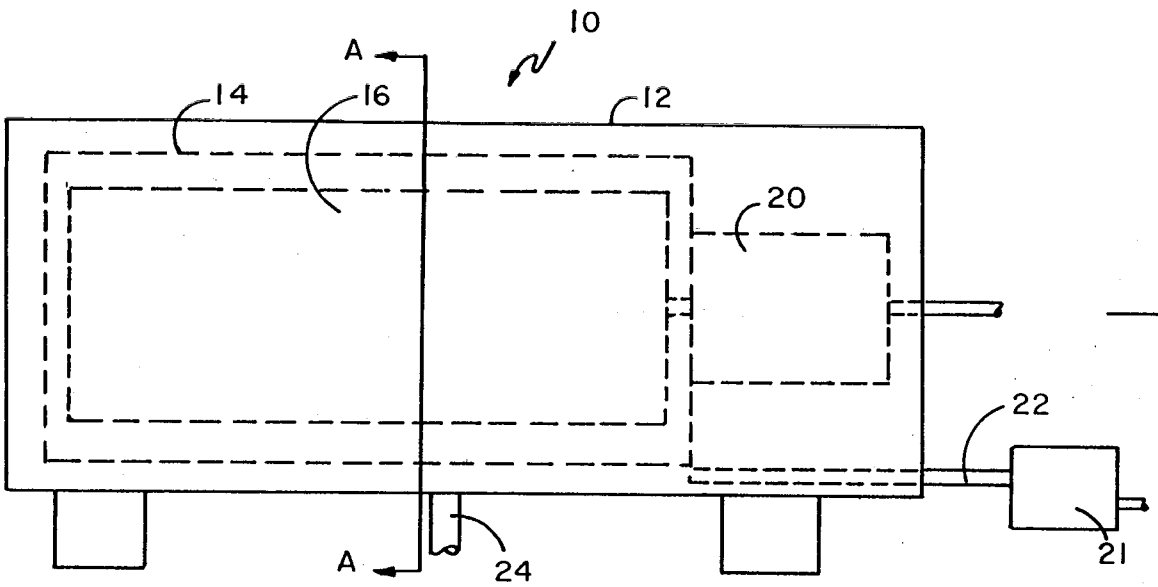
FIG. 2 illustrates a side view of the device of this invention.
Figure 3:
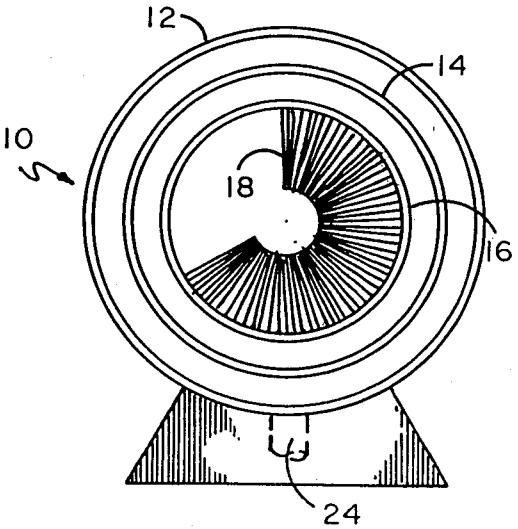
FIG. 3 illustrates a cross-sectional view through A—A of FIG. 2.

FIG. 1, seen in an angular perspective cutaway view, illustrates first outer drum 12 through which the supply of water 22 enters from the rear as more clearly seen in FIG. 2. At the rear of first outer drum 12 is an aperture through which the shaft of an electric motor 20 or other movement means is connected to third rotatable drum 16. Within first outer drum 12 is perforated stationary second drum 14 which allows the water passing through first outer drum 12 to rise between the two drums and pass through the apertures in the stationary second drum 14 at all points therearound. The perforated third inner rotatable drum 16 can be rotated by electric motor 20. Brush members 18 are affixed on the inside of third drum. Brush members 18 can be held thereon in one embodiment by self-tapping rubber grommets in holes provided in the rotatable drum which hold a brush ring within the drum. Such brush members can also be affixed by glue or attached by any other suitable means to the inside surface of rotatable third drum 16. The brushes can be held in slots to slide out for easy replacement. Apertures are provided in third drum 16 to allow water which passes therethrough to reach the hand which is inserted within the center of the device. The hand can be inserted through a plurality of front flaps 20 seen in FIG. 4 which can be of a flexible plastic-like material cut in sectors. These flaps assist in preventing water from splashing out the front of the unit. The unit can be turned on or off by switch button 23 or by equivalent operational means. Supply of water 22, water temperature and the addition of soap and/or chemicals to the water supply can be controlled by control means 21. The entry of the soap or other cleansing agent into the water supply is well known technology found in other fields for the addition of particular substances into a water supply on a timed or controlled basis. Drain 24 can also be provided in the base of outer drum 12 to allow water to drain out of the device.

In use one would maneuver one's fingers to be exposed on the inside between the fingers to the bristles of the brush members as they pass by. As third rotatable drum 16 rotates, the water which has passed through second drum 14, passes around and enters washing area 15 in the center of drum 16 from all sides thereby surrounding the user's hand with water. After each use, the device can go through an internal sterilization cleaning cycle such as by running extremely hot water with a strong chemical cleaner added through the system followed by rinse water to remove any dirt or bacteria left on the brush members from a previous user.

Perforated stationary second drum 14 can be affixed within first outer drum 12 at its rear or at any suitable place for attachment thereof. The device can be mounted on a base and located anywhere to which electricity for motor power and water supply are available. The water supply could also be supplied by a a separate auxiliary tank so that the device can be used away from a piped water supply such as in an emergency medical vehicle.

Although the present invention has been described with reference to particular embodiments, it will be apparent to those skilled in the art that variations and modifications can be substituted therefor without departing from the principles and spirit of the invention.

I claim:

1. A hand-washing device, comprising:

an outer drum;

a stationary drum having a plurality of perforations defined therearound positioned concentrically within said outer drum;

a movable drum having a plurality of perforations defined therearound positioned concentrically within said perforated stationary drum;

means to rotate said movable drum;

water entry means adapted to enter water into said outer drum, and, once entered in said outer drum, to pass through the perforations in said stationary drum and then through the perforations in said movable drum;

brush members concentrically positioned around the inside of said movable drum adapted to receive water through the perforations in said movable drum to wash a hand inserted into said movable drum while it is rotating; and drain means to remove said water which has passed through said device.

2. The device of claim 1 further including means to enter a cleansing agent into said water supply at various selected times.

3. The device of claim 2 further including closure means on the front of said unit to prevent water from coming out of said unit, said closure means including flexible sector-shaped front flap members that move aside to allow for insertion of a user's hand into said unit.

* * * * *